US010150211B2

(12) United States Patent
Cheng

(10) Patent No.: US 10,150,211 B2
(45) Date of Patent: Dec. 11, 2018

(54) STEERING-SWITCHING AND HANDS-CHANGING ASSEMBLY FOR A PNEUMATIC TOOL

(71) Applicant: Ming-Ta Cheng, Taichung (TW)

(72) Inventor: Ming-Ta Cheng, Taichung (TW)

( * ) Notice: Subject to any disclaimer, the term of this patent is extended or adjusted under 35 U.S.C. 154(b) by 367 days.

(21) Appl. No.: 15/217,331

(22) Filed: Jul. 22, 2016

(65) Prior Publication Data

US 2018/0021933 A1 Jan. 25, 2018

(51) Int. Cl.
*B25F 5/02* (2006.01)
*B25B 21/00* (2006.01)

(52) U.S. Cl.
CPC ..... *B25F 5/02* (2013.01); *B25B 21/00* (2013.01)

(58) Field of Classification Search
CPC .. B25F 5/00; B25F 5/001; B25F 5/021; B25F 5/02
USPC ..... 173/1–2, 13–17, 100–115, 124–129, 173/131–138, 141, 168–170, 184, 189, 173/193, 200–201, 204, 207, 218
See application file for complete search history.

(56) References Cited

U.S. PATENT DOCUMENTS 4,016,941 A * 4/1977 Sanders ..... B23D 29/00 173/170
2007/0011884 A1* 1/2007 Hua ..... B25B 21/00 30/276
2013/0081843 A1* 4/2013 Tully ..... B25F 5/02 173/221
2014/0290973 A1* 10/2014 Lin ..... B25F 5/02 173/104

* cited by examiner

*Primary Examiner* — Robert Long
(74) *Attorney, Agent, or Firm* — Huffman Law Group, PC

(57) ABSTRACT

A steering-switching and hands-changing assembly for a pneumatic tool has a switching set, a speed-adjusting set, and a trigger set. The switching set has a selector valve and a switching stem. The selector valve is hollow and has a valve hole and an engaging seat. The switching stem is detachably connected to the selector valve and has an engaging claw and a toggle arm. The engaging claw selectively engages with the engaging seat. The speed-adjusting set is connected to the switching set and has a speed button. The speed button is movably and rotatably connected to the switching stem and has a mounting tube and a rotating tray. The trigger set is connected to the switching set and the speed-adjusting set, and has a trigger rod, a trigger, and an elastic element.

11 Claims, 11 Drawing Sheets

STEERING-SWITCHING AND HANDS-CHANGING ASSEMBLY FOR A PNEUMATIC TOOL

BACKGROUND OF THE INVENTION

1. Field of the Invention

The present invention relates to a steering-switching and hands-changing assembly, and more particularly to a steering-switching and hands-changing assembly for a pneumatic tool that may conveniently and safely adjust a toggling direction of the steering-switching and hands-changing assembly relative to the pneumatic tool.

2. Description of Related Art

A conventional pneumatic tool has a steering-switching and hands-changing assembly mounted in a handle of the conventional pneumatic tool to control the flow direction of compressed air and to change the turning direction of different dominant hands. The steering-switching and hands-changing assembly has a selector valve, a switching stem, a speed button, a trigger rod, a trigger, and an elastic element.

The selector valve is rotatably mounted in an air-inlet channel of the conventional pneumatic tool, and has an external surface, an outer end, an inner end, a through slot, a gas hole, and a positioning segment. The inner end of the selector valve is mounted in the handle. The outer end of the selector valve extends out of the handle. The through slot is formed through the inner end and the outer end of the selector valve. The gas hole is formed through the external surface of the selector valve adjacent to the inner end of the selector valve. The positioning segment is deposited on the outer end of the selector valve.

The switching stem is connected to the selector valve and has an assembling segment and a toggle segment. The assembling segment is connected to the outer end of the selector valve and has an inner side and a locating segment. The inner side of the assembling segment faces the positioning segment of the selector valve. The locating segment is deposited on the inner side of the assembling segment and engages with the positioning segment. The toggle segment is formed on and protrudes from the assembling segment, and extends toward a side of the handle.

The trigger rod is mounted through the selector valve via the through slot, and has an inner end, an outer end, a limiting protrusion, and a connecting segment. The inner end of the trigger rod extends out of the inner end of the selector valve. The outer end of the trigger rod extends out of the handle via the through slot and the outer end of the selector valve. The limiting protrusion is formed on and protrudes from the inner end of the trigger rod and abuts against the inner end of the selector valve to prevent the trigger rod from moving outwardly relative to the selector valve. The connecting segment is formed on the outer end of the trigger rod. The trigger is connected to the connecting segment of the trigger rod. The speed button is rotatably and movably connected to the through slot of the selector valve. The elastic element is deposited between the speed button and the trigger.

When a user's right hand holds the handle of the conventional pneumatic tool, the thumb of the user's right hand may toggle the toggle segment of the switching stem to enable the conventional pneumatic tool to rotate in a forward direction (clockwise direction) or in a reverse direction (counterclockwise direction). When a user's left hand is to hold the handle to operate the conventional pneumatic tool, the speed button is pushed forwardly to the trigger to compress the elastic element to form a relative movement space between the switching stem and the selector valve. Then, the locating segment of the switching stem may disengage from the positioning segment of the selector valve, and this enables the switching stem to rotate relative to the selector valve. With the rotation of the switching stem relative to the selector valve, the toggle segment of the switching stem is rotated with the switching stem and is moved to another side of the handle. Consequently, the thumb of the user's left hand may toggle the toggle segment of the switching stem to control the rotating direction of the conventional pneumatic tool.

The steering-switching and hands-changing assembly of the conventional pneumatic tool may enable the conventional pneumatic tool to be adjusted to fit with different dominant hands of users to enable the user to hold and control the rotating direction of the conventional pneumatic tool by one hand. However, the positioning segment and the locating segment between the selector valve and the switching stem engage with each other by the elastic element pushing the switching stem via the speed button, and the engaging-positioning force between the positioning segment and the locating segment is obviously insufficient. When the user wants to control the rotating direction of the conventional pneumatic tool by toggling the switching stem, if the pushing force of the user's thumb is larger than the elastic force of the elastic element, the locating segment of the switching stem may be disengaged from the positioning segment of the selector valve. Then, the toggle segment of the switching stem may move to another side of the handle, and this may be inconvenient and unsafe in use. Furthermore, the poor positioning effect between the positioning segment of the selector valve and the locating segment of the switching stem may cause damage to other components of the conventional pneumatic tool after a long time of use.

Additionally, when the switching stem is damaged after a long time and needs to be replaced, since the assembling segment of the switching stem is an enclosed ring structure, the switching stem cannot be detached from the selector valve directly. Then, the user may firstly need to remove the trigger, the elastic element, and the speed button from the selector valve, and the switching stem may detach from the selector valve later. The above-mentioned operation may increase the cost and time of maintaining and replacing the components of the steering-switching and hands-changing assembly of the conventional pneumatic tool.

The steering-switching and hands-changing assembly for a pneumatic tool in accordance with the present invention mitigates or obviates the aforementioned problems.

SUMMARY OF THE INVENTION

The main objective of the present invention is to provide a steering-switching and hands-changing assembly for a pneumatic tool that may conveniently and safely adjust a toggling direction of the steering-switching and hands-changing assembly relative to the pneumatic tool.

The steering-switching and hands-changing assembly in accordance with the present invention for a pneumatic tool has a switching set, a speed-adjusting set, and a trigger set. The switching set has a selector valve and a switching stem. The selector valve is hollow and has a valve hole and an engaging seat. The switching stem is detachably connected to the selector valve and has an engaging claw and a toggle arm. The engaging claw selectively engages with the engaging seat. The speed-adjusting set is connected to the switching set and has a speed button. The speed button is movably and rotatably connected to the switching stem and has a mounting tube and a rotating tray. The trigger set is connected to the switching set and the speed-adjusting set, and has a trigger rod, a trigger, and an elastic element.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
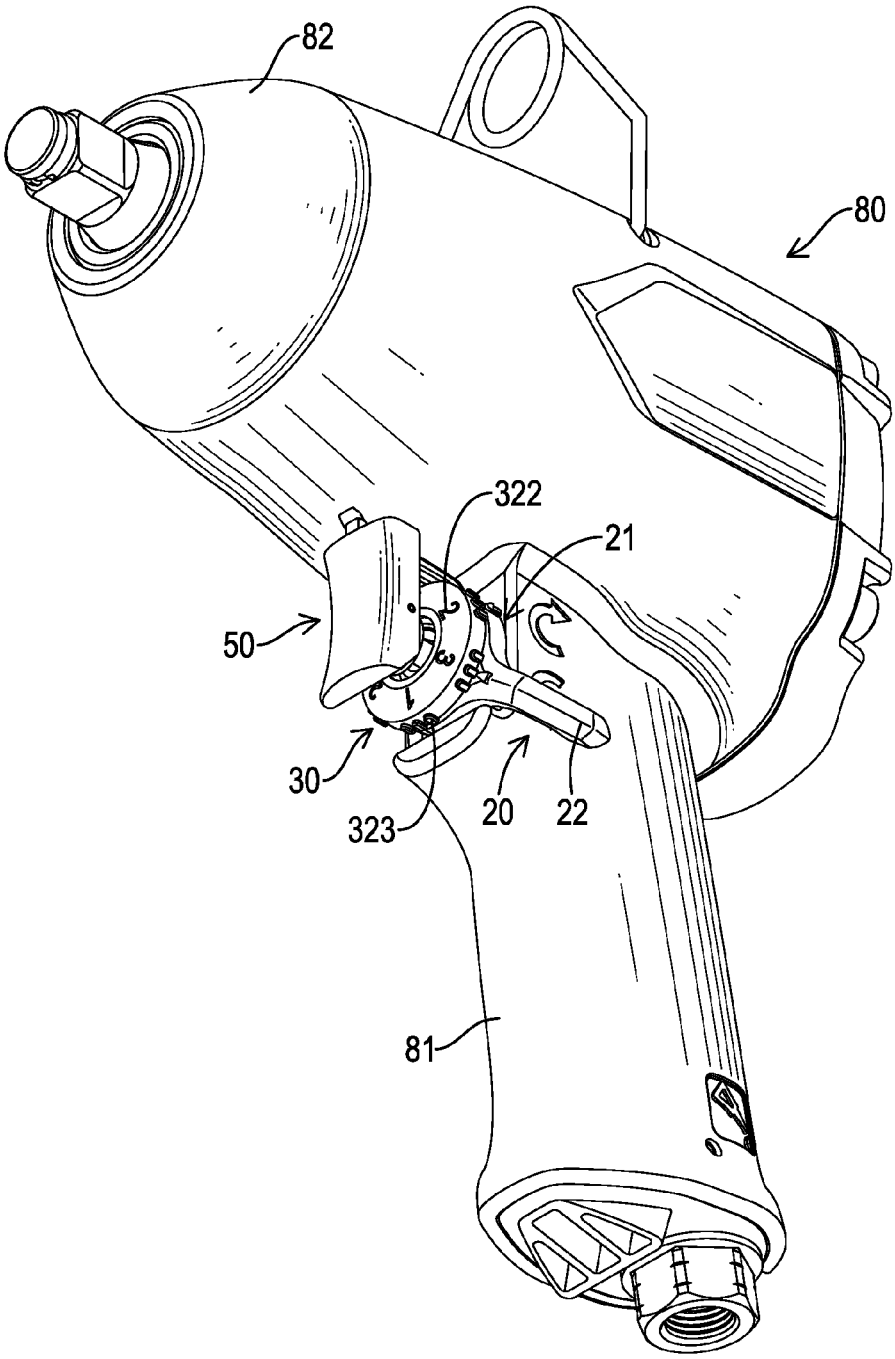
FIG. 1 is a perspective view of a first embodiment of a steering-switching and hands-changing assembly in accordance with the present invention, mounted on a pneumatic tool.
Figure 2:
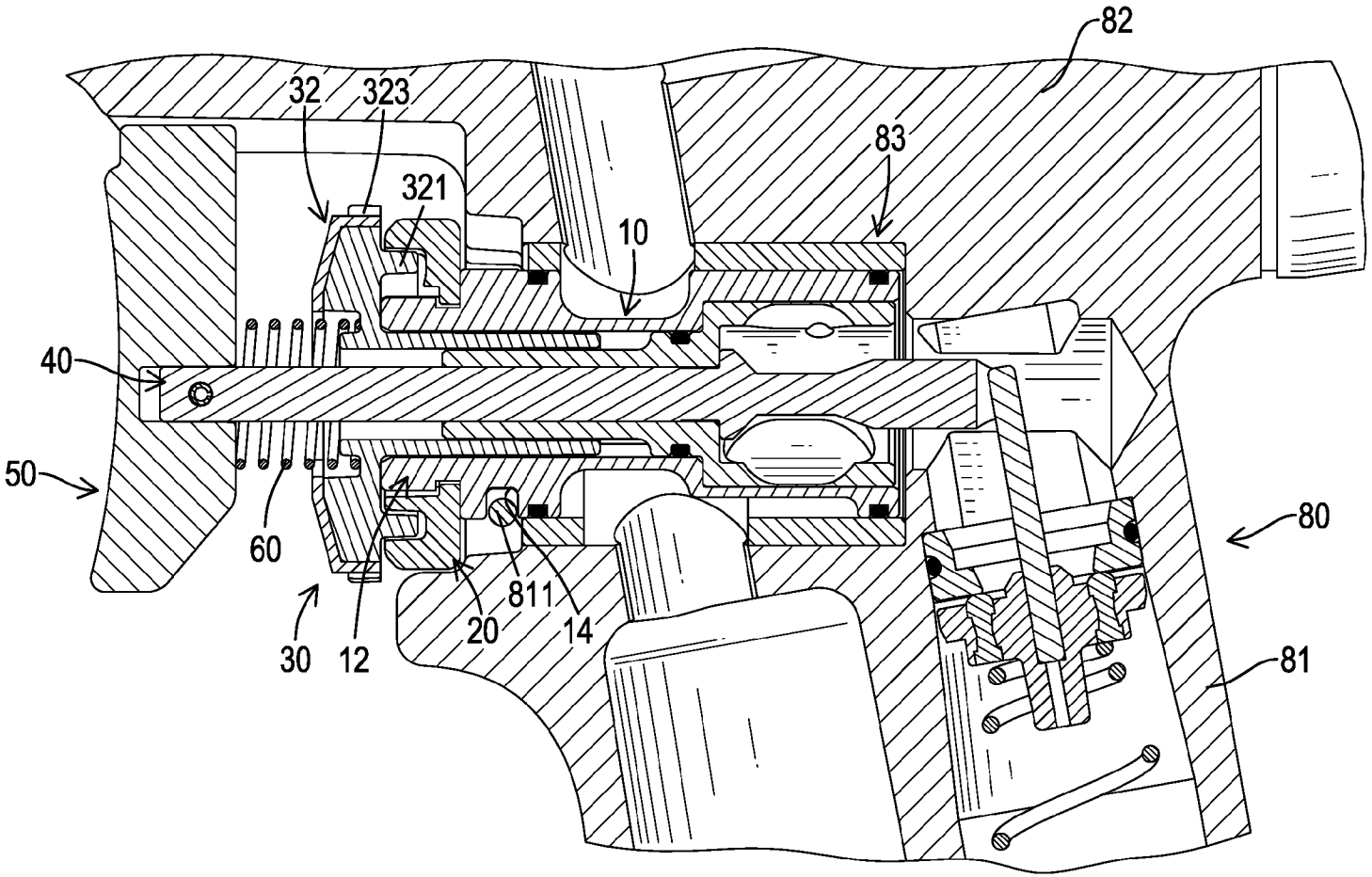
FIG. 2 is an enlarged side view of the steering-switching and hands-changing assembly in FIG. 1, mounted on the pneumatic tool.
Figure 3:
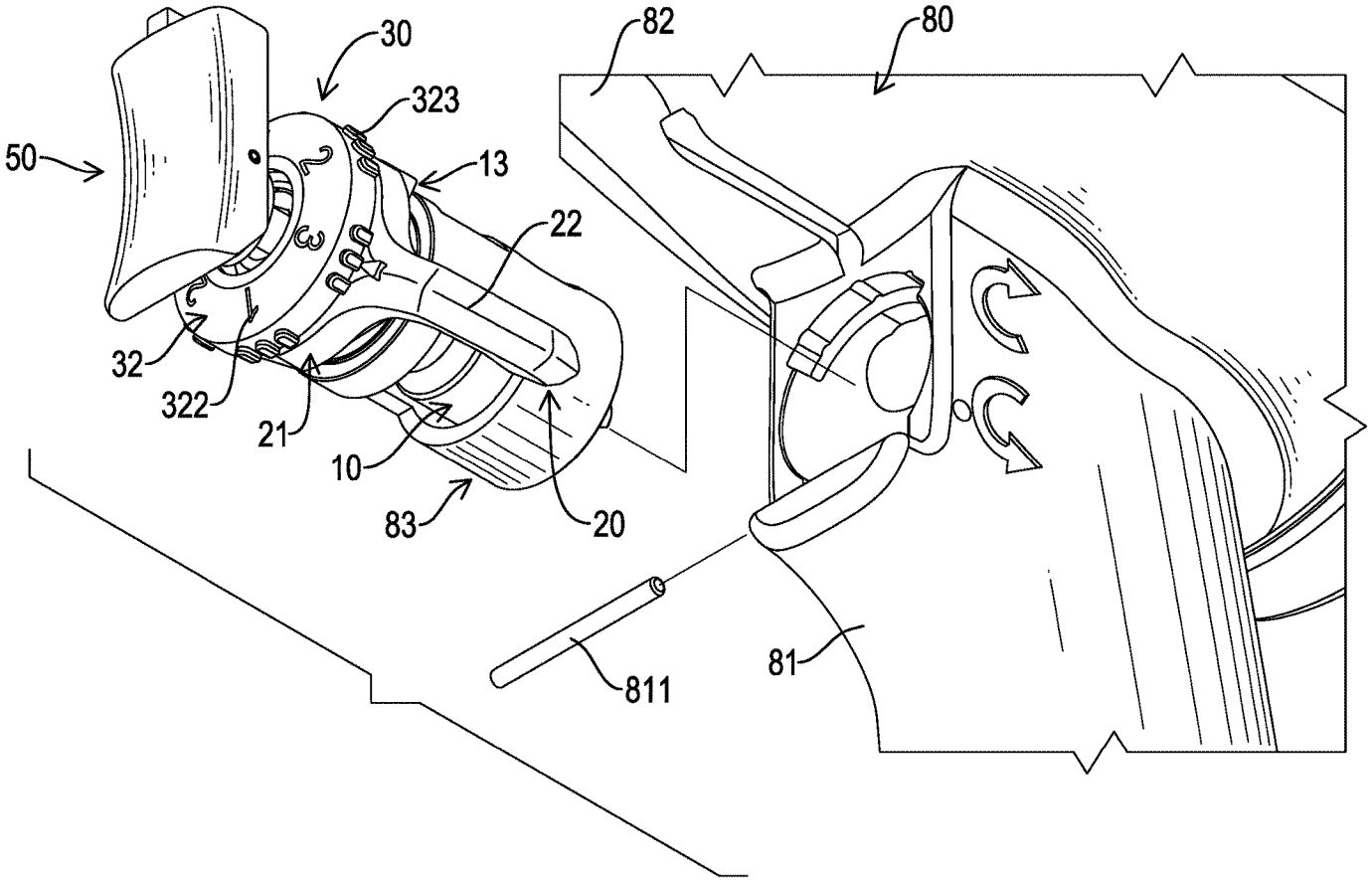
FIG. 3 is an enlarged perspective view of the steering-switching and hands-changing assembly in FIG. 1, separated from the pneumatic tool.

With reference to FIG. 1, a steering-switching and hands-changing assembly in accordance with the present invention for a pneumatic tool 80 is mounted between a handle 81 and a gun body 82, and is held securely on the pneumatic tool 80 by a positioning pin 811 of the handle 81 as shown in FIGS. 2 and 3. The pneumatic tool 80 further has an airflow guiding set 83 and a cylinder set. The airflow guiding set 83 is mounted between the handle 81 and the gun body 82. The cylinder set is mounted in the gun body 82 and communicates with the airflow guiding set 83. Furthermore, the pneumatic tool 80 is conventional, and the features, the structures, and the operations of the pneumatic tool 80 are not described in detail.

The steering-switching and hands-changing assembly has a switching set, a speed-adjusting set, and a trigger set.

Figure 4A:
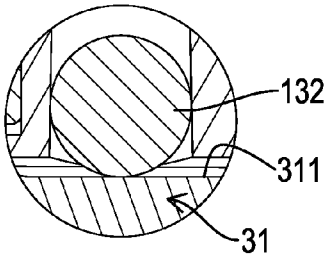
FIG. 4A is a further enlarged side view of the steering-switching and hands-changing assembly in FIG. 4.
Figure 4:
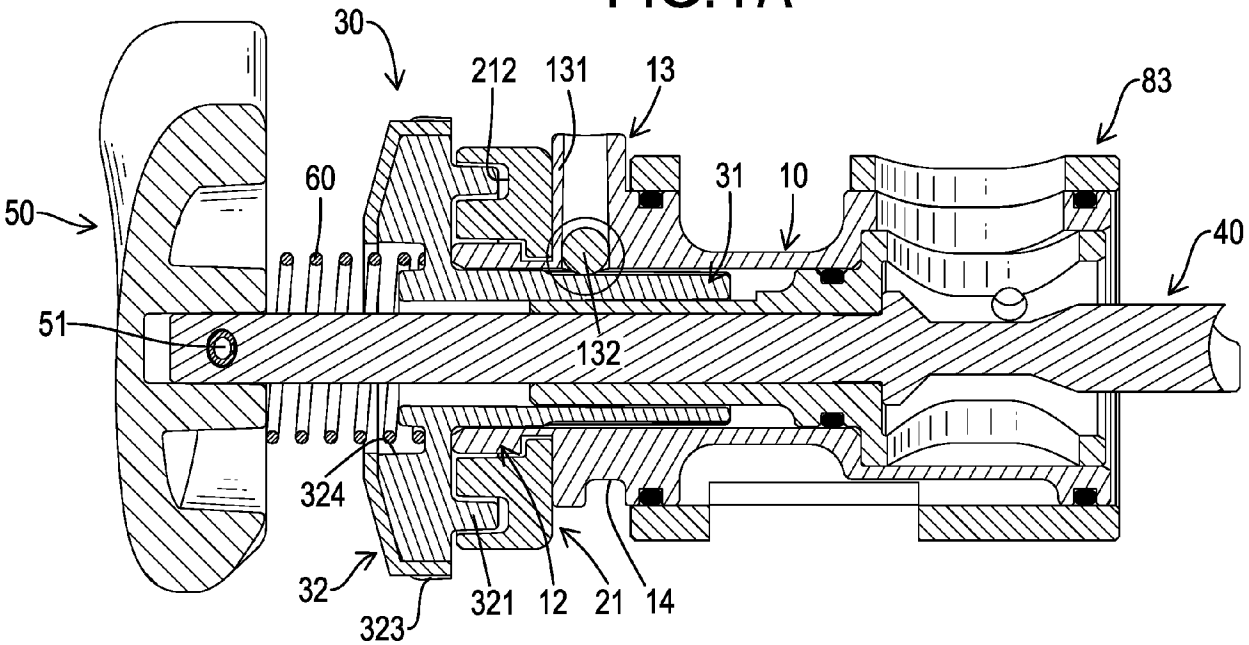
FIG. 4 is an enlarged side view of the steering-switching and hands-changing assembly in FIG. 3.
Figure 5:
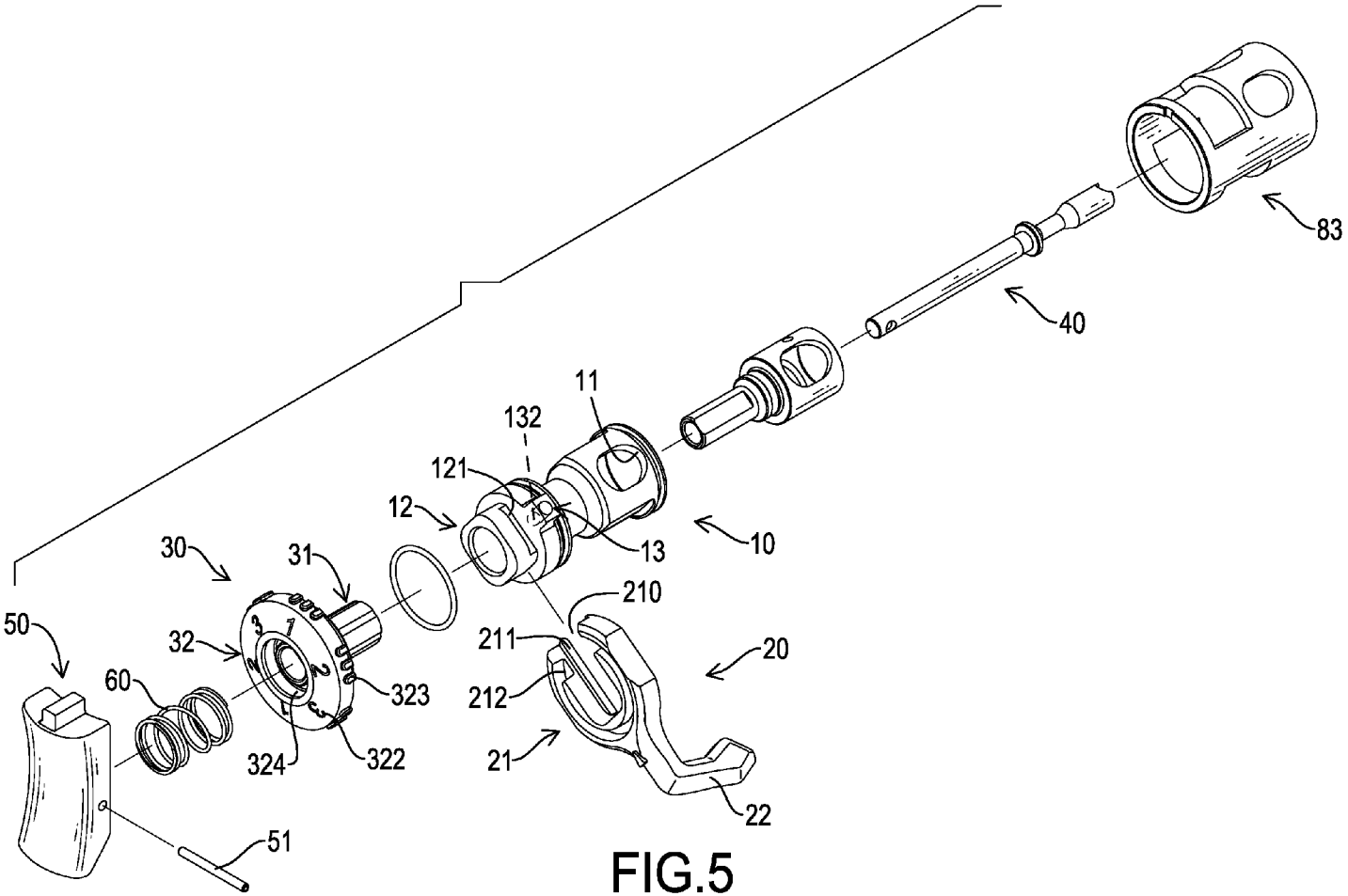
FIG. 5 is an exploded perspective view of the steering-switching and hands-changing assembly in FIG. 3.
Figure 6:
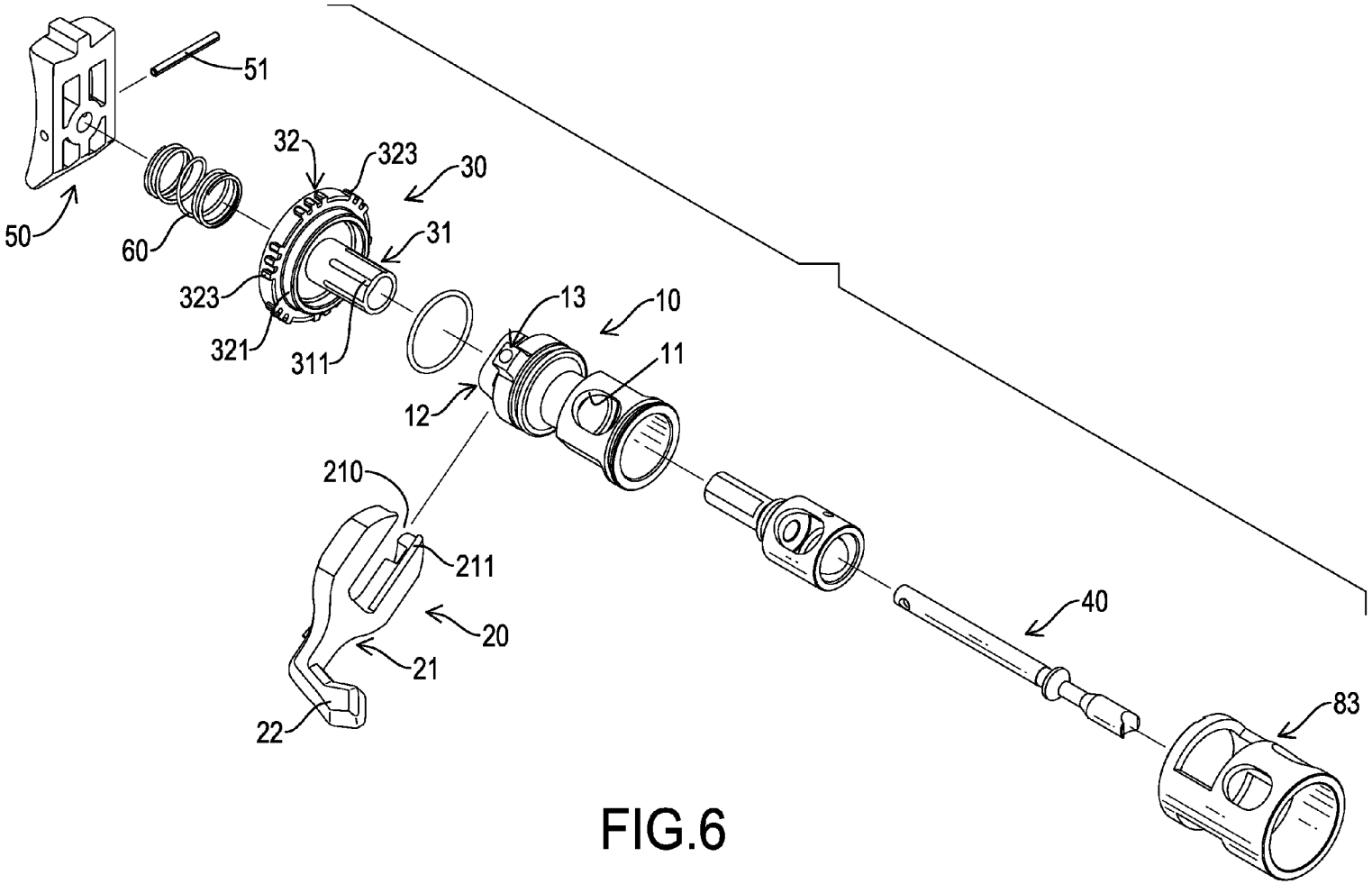
FIG. 6 is another exploded perspective view of the steering-switching and hands-changing assembly in FIG. 3.

With reference to FIGS. 4 to 6, the switching set is connected to the handle 81 of the pneumatic tool 80 below the gun body 82, and has a selector valve 10 and a switching stem 20.

The selector valve 10 is hollow, is rotatably mounted in the handle 81 and communicates with the gun body 82. The selector valve 10 has a front end, a rear end, an external surface, a valve hole 11, an engaging seat 12, a button-positioning structure 13, and a pin recess 14. The front end of the selector valve 10 extends out of the handle 81. The valve hole 11 is formed through the external surface of the selector valve 10 adjacent to the rear end of the selector valve 10, and communicates with the airflow guiding set 83 of the pneumatic tool 80 to enable the pneumatic tool 80 to rotate in a forward direction (clockwise direction) or in a reverse direction (counterclockwise direction).

Figure 7:
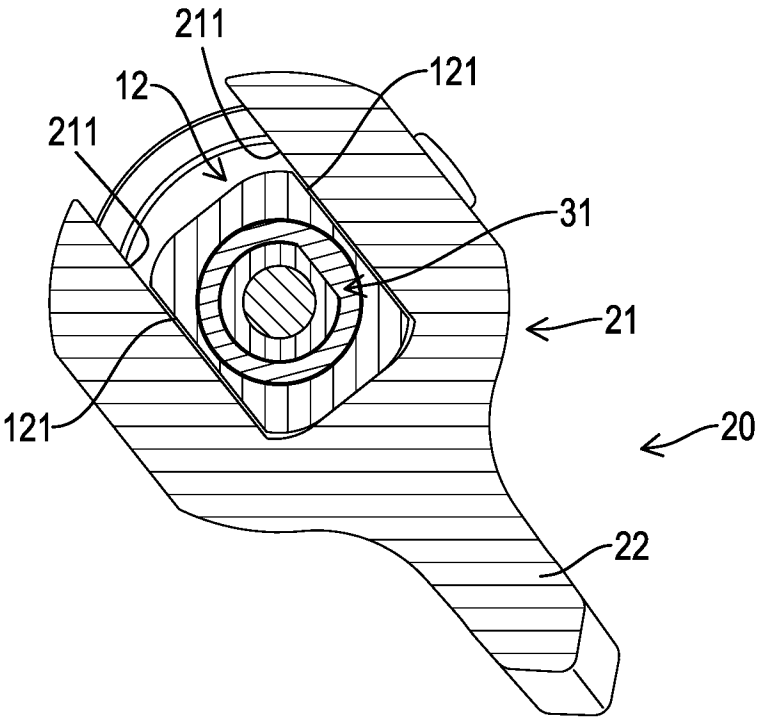
FIG. 7 is an enlarged front side view of the steering-switching and hands-changing assembly in FIG. 3.

With reference to FIGS. 2, 5, and 7, the engaging seat 12 may be a polygonal hollow seat, is axially formed on and protrudes from an outer side of the front end of the selector valve 10, and has an external surface and multiple engaging concave faces 121. The engaging concave faces 121 are formed around the external surface of the engaging seat 12 at spaced intervals.

Figure 8:
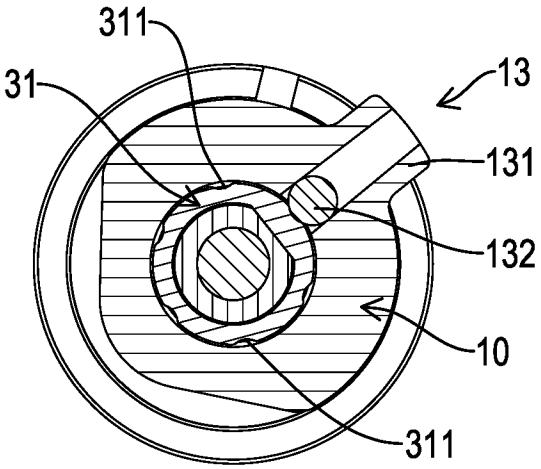
FIG. 8 is another enlarged front side view of the steering-switching and hands-changing assembly in FIG. 3.

With reference to FIGS. 4, 5, and 8, the button-positioning structure 13 is deposited on the external surface of the selector valve 10 adjacent to the engaging seat 12. The button-positioning structure 13 has a holding protrusion 131 and a positioning ball 132. The holding protrusion 131 is radially formed on and protrudes from the external surface of the selector valve 10 adjacent to the engaging seat 12, and communicates with an interior of the selector valve 10. The positioning ball 132 is mounted in the holding protrusion 131 and partially extends into the interior of the selector valve 10.

With further reference to FIGS. 2 to 4, the pin recess 14 is formed in the external surface of the selector valve 10 adjacent to the button-positioning structure 13. Then, the positioning pin 811 of the pneumatic tool 80 may hold the selector valve 10 securely on the handle 81 by being inserted in the pin recess 14 of the selector valve 10.

With reference to FIGS. 6 and 7, the switching stem 20 is detachably connected to the selector valve 10 at a side of the handle 81, and has an engaging claw 21 and a toggle arm 22. The engaging claw 21 selectively engages with the engaging seat 12 of the selector valve 10 to hold the switching stem 20 on the handle 81 by the selector valve 10. The engaging claw 21 may be U-shaped and has an inner side, an outer side, an external surface, a notch 210, two engaging ribs 211, and an engaging recess 212. The inner side of the engaging claw 21 faces the outer side of the front end of the selector valve 10. The notch 210 is formed through the outer side and the inner side of the engaging claw 21 to form the U-shaped engaging claw 21. The engaging ribs 211 are formed on and protrude from the inner side of the engaging claw 21 beside the notch 210, and respectively engage with two of the engaging concave faces 121 of the engaging seat 12 to enable the engaging claw 21 to engage with the engaging seat 12. The engaging recess 212 is formed in the outer side of the engaging claw 21 and communicates with the notch 210. Then, the notch 210 and the engaging recess 212 are formed as an annular structure at the outer side of the engaging claw 21. The toggle arm 22 is formed on and protrudes outwardly from the external surface of the engaging claw 21 and is opposite to the notch 210 of the engaging claw 21. Then, the user may toggle the switching stem 20 relative to the pneumatic tool 80 by pushing the toggle arm 22.

The speed-adjusting set is connected to the switching set below the gun body 82, and has a speed button 30. The speed button 30 is movably and rotatably connected to the switching stem 20 and has a mounting tube 31 and a rotating tray 32.

The mounting tube 31 is hollow, extends into the selector valve 10 via the engaging seat 12, and has an inner end, an outer end, an external surface, and at least two ball recesses 311. The inner end of the mounting tube 31 is mounted in the selector valve 10 via the engaging seat 12. The outer end of the mounting tube 31 extends out of the selector valve 10 in front of the outer side of the engaging claw 21 via the engaging seat 12. The at least two ball recesses 311 are axially formed in the external surface of the mounting tube 31 at a spaced interval.

With reference to FIGS. 4, 4A, and 8, the positioning ball 132 of the button-positioning structure 13 engages with the mounting tube 31 at one of the at least two ball recesses 311 to hold the mounting tube 31 securely with the selector valve 10 by the engagement between the positioning ball 132 and the at least two ball recesses 311. Furthermore, each one of the at least two ball recesses 311 is axially formed in the external surface of the mounting tube 31, and this enables the mounting tube 31 to move axially relative to the selector valve 10 by the positioning ball 132 moving along one of the at least two ball recesses 311.

The rotating tray 32 is connected to the external surface of the mounting tube 31 at the outer end of the mounting tube 31 in front of the outer side of the engaging claw 21, and has an inner side, an outer side, an external surface, an engaging flange 321, multiple numeral marks 322, multiple protruding tabs 323, and a mounting recess 324. The inner side of the rotating tray 32 faces the outer side of the engaging claw 21. The engaging flange 321 is annular, is axially formed on and protrudes from the inner side of the rotating tray 32 around the mounting tube 31, and is mounted in the annular structure of the engaging claw 21 that is formed by the notch 210 and the engaging recess 212. Then, the rotating tray 32 abuts the engaging seat 12 and the engaging claw 21 as shown in FIGS. 2 and 4.

Additionally, the numeral marks 322 are formed on the outer side of the rotating tray 32 at spaced intervals and corresponding to a rotating speed of the pneumatic tool 80. The protruding tabs 323 are annularly formed on and protrude from the external surface of the rotating tray 32 at spaced intervals to enable the user to rotate the rotating tray 32 easily. Furthermore, the mounting recess 324 is formed in the outer side of the rotating tray 32 around the outer end of the mounting tube 31 as shown in FIGS. 4 and 5.

The trigger set is connected to the switching set and the speed-adjusting set below the gun body 82, and has a trigger rod 40, a trigger 50, and an elastic element 60.

With reference to FIGS. 2 and 4, the trigger rod 40 is mounted through the selector valve 10, the switching stem 20, and the speed button 30, and has an inner end and an outer end. The inner end of the trigger rod 40 is mounted in the handle 81 and abuts one of the components of the airflow guiding set 83. The outer end of the trigger rod 40 extends in front of the outer side of the rotating tray 32 via the airflow guiding set 83, the selector valve 10, the mounting tube 31, and the mounting recess 324. The trigger 50 is connected to the outer end of the trigger rod 40 in the front of the speed button 30. Furthermore, the trigger 50 has a fixing pin 51 to connect the outer end of the trigger rod 40 securely with the trigger 50.

Additionally, with reference to FIGS. 2 and 4, a distance is formed between the rotating tray 32 of the speed button 30 and the trigger 50, and the elastic element 60 is mounted around the trigger rod 40 that extends out of the speed button 30, is mounted in the mounting recess 324, and abuts the rotating tray 32 and the trigger 50. Then, the rotating tray 32 abuts the engaging claw 21 by an elastic force of the elastic element 60, and the engaging flange 321 of the rotating tray 32 is mounted between the engaging recess 212 and the notch 210 of the engaging claw 21 to maintain the distance between the rotating tray 32 of the speed button 30 and the trigger 50.

Figure 9:
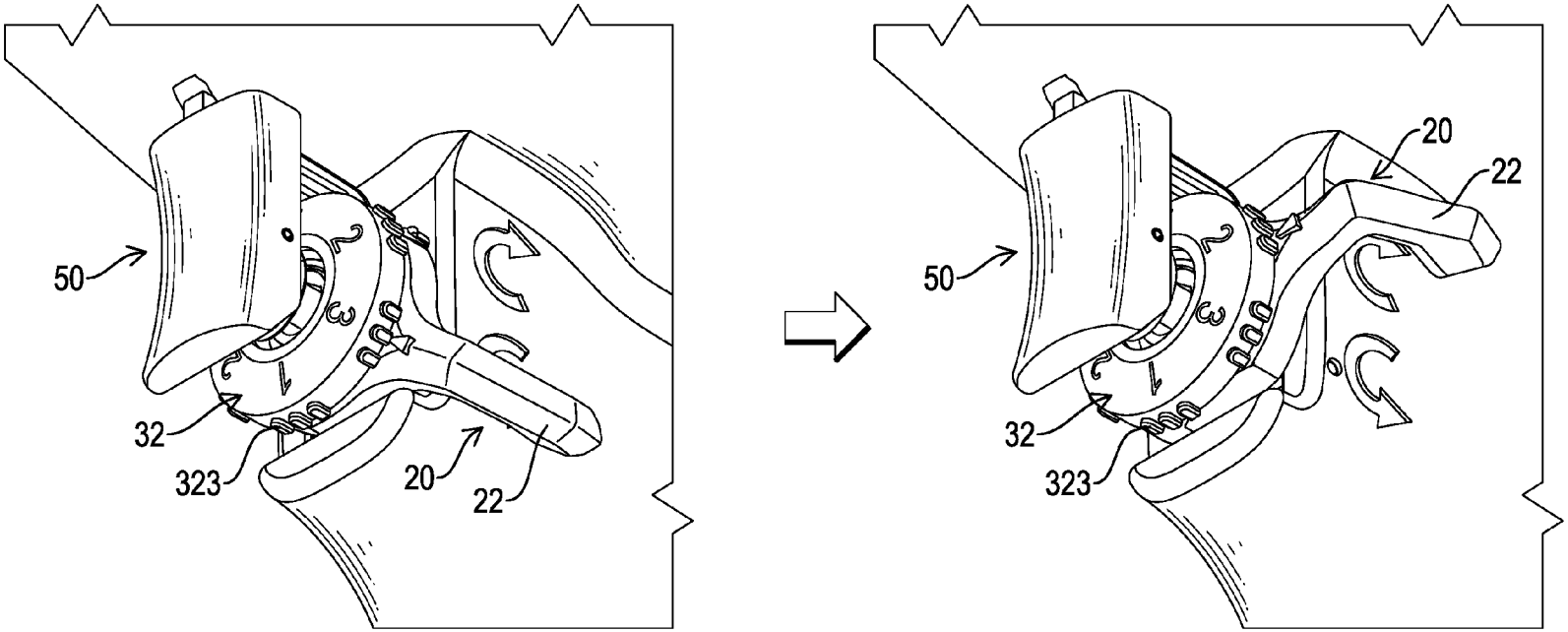
FIG. 9 shows operational perspective views of the steering-switching and hands-changing assembly in FIG. 1, changing the rotating direction of the pneumatic tool.

With reference to FIG. 1, in use, a user's right hand holds the handle 81 of the pneumatic tool 80, and the thumb of the user's right hand is adjacent to the toggle arm 22 of the switching stem 20. With reference to FIG. 9, when the user wants to control the rotating direction (in a forward direction or in a reverse direction) of the pneumatic tool 80, the thumb of the user's right hand may toggle the toggle arm 22 of the switching stem 20 to change the rotating direction of the pneumatic tool 80 conveniently and easily. Furthermore, with reference to FIGS. 2 and 4, during the above-mentioned operation, the elastic element 60 between the trigger 50 and the speed button 30 may provide a pushing force to the speed button 30 to enable the speed button 30 to abut against the engaging claw 21, and the engaging flange 321 of the rotating tray 32 engages with the annular structure that is formed by the notch 210 and the engaging recess 212 of the engaging claw 21 at the same time.

Therefore, when the toggling force of the user's thumb is larger than the elastic force of the elastic element 60, the engagement between the engaging flange 321 of the rotating tray 32 and the notch 210 and the engaging recess 212 of the engaging claw 21 may prevent the switching stem 20 from separating from the speed button 30 during the above-mentioned operation, and this can prevent the switching stem 20 from moving to another side of the handle 81. Consequently, the user may operate the pneumatic tool 80 by the steering-switching and hands-changing assembly of the present invention conveniently and safely. Additionally, the improved positioning effect between the selector valve 10 and the switching stem 20 may prevent the components of the pneumatic tool 80 from damage after a long time of use.

Figure 10:
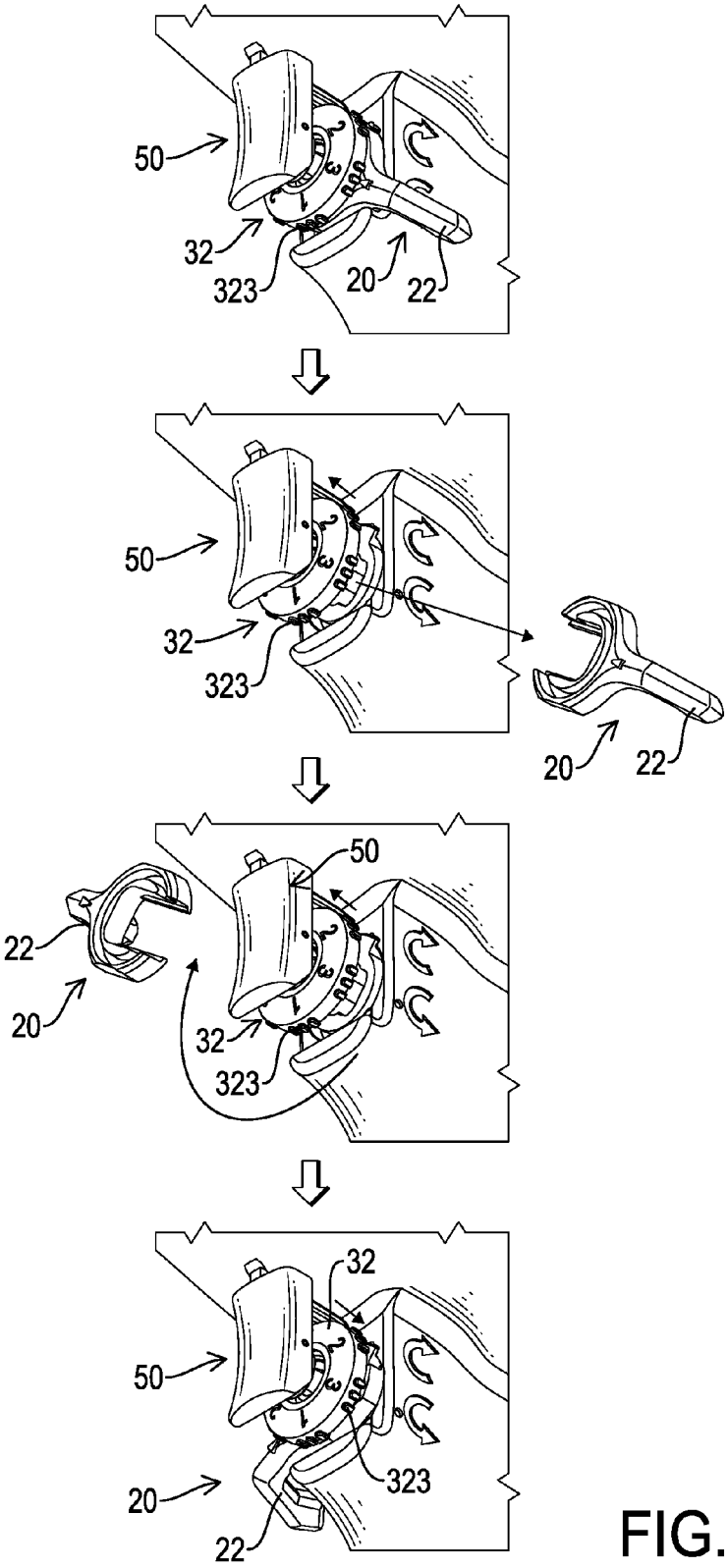
FIG. 10 shows operational perspective views of the steering-switching and hands-changing assembly in FIG. 1, adjusting the toggling direction of the steering-switching and hands-changing assembly.

With reference to FIGS. 4 and 10, when a user's left hand holds the handle 81 of the pneumatic tool 80 and is to operate the steering-switching and hands-changing assembly, the speed button 30 is pushed to move along the trigger rod 40 toward the trigger 50 to compress the elastic element 60. Then, the engaging flange 321 of the rotating tray 32 is separated from the engaging recess 212 of the engaging claw 21. Since the engaging claw 21 has the notch 210, the engaging claw 21 may directly separate from the engaging seat 12 of the selector valve 10 to enable the switching stem 20 to separate from the selector valve 10.

With reference to FIG. 7, the switching stem 20 is moved at the other side of the handle 81 of the pneumatic tool 80, and the engaging claw 21 of the switching stem 20 engages two of the engaging concave faces 121 of the engaging seat 12 again. When the user releases the speed button 30, the compressed elastic element 60 may push the speed button 30 back to the original position to enable the engaging flange 321 of the rotating tray 32 to engage the engaging recess 212 of the engaging claw 21 again. Then, the thumb of the user's left hand is adjacent to the toggle arm 22 of the switching stem 20, and may toggle the toggle arm 22 of the switching stem 20 to change the rotating direction of the pneumatic tool 80 conveniently and easily.

Furthermore, with reference to FIGS. 4 and 8, when the user rotates the rotating tray 32 to adjust the rotating speed of the pneumatic tool 80, the engagement between the positioning ball 132 of the button-positioning structure 13 and the at least two ball recesses 311 of the mounting tube 31 may provide a quantitative rotation effect to the user to prevent excessive rotating of the rotating tray 32. Additionally, when the switching stem 20 is damaged after a long time and needs to be replaced, since the switching stem 20 has the notch 210 and may separate from the engaging seat 12 of the selector valve 10 conveniently without detaching the trigger 50, the elastic element 60, and the speed button 30, and this may reduce the cost and time of maintaining and replacing the components of the steering-switching and hands-changing assembly of the present invention.

Figure 11:
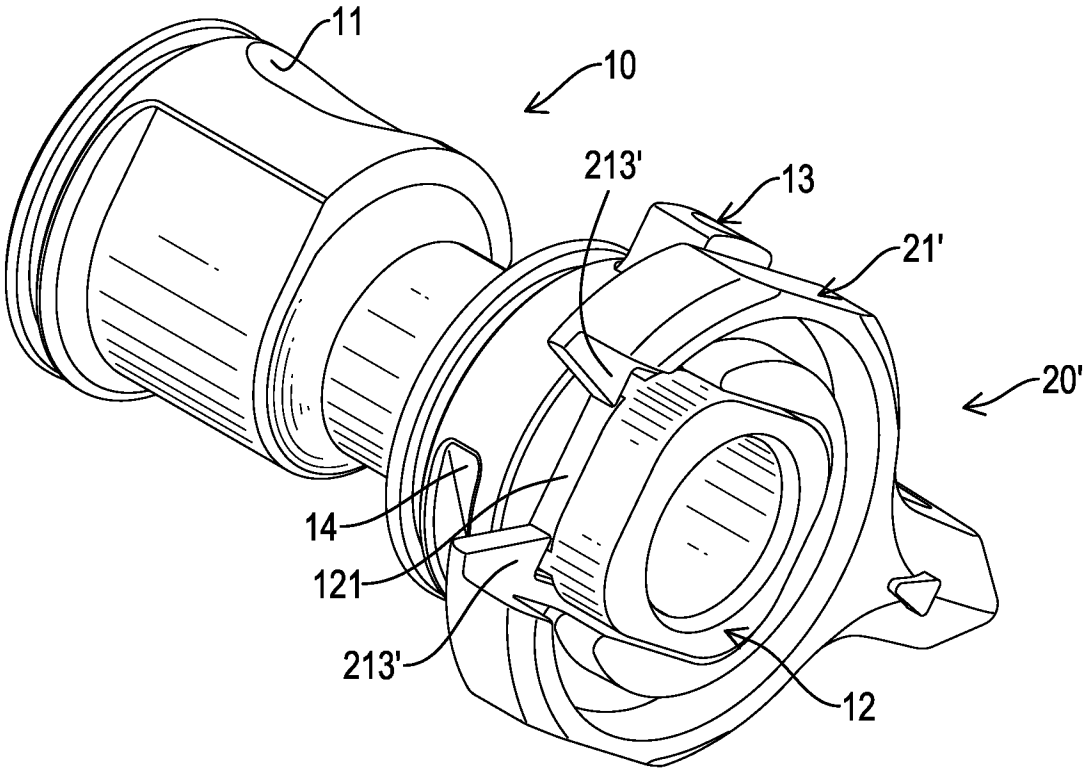
FIG. 11 is an enlarged perspective view of a second embodiment of a steering-switching and hands-changing assembly in accordance with the present invention.

With reference to FIG. 11, a second embodiment of a steering-switching and hands-changing assembly in accordance with the present invention is substantially the same as the first embodiment except for the following features. The engaging claw 21' of the switching stem 20' further has two free ends and two holding jaws 213'. The holding jaws 213' are respectively formed on the free ends of the engaging claw 21' to enable the holding jaws 213' to engage with one of the engaging concave faces 121 of the engaging seat 12 to provide a preferred engaging structural strength. Then, the switching stem 20' may engage the selector valve 10 more securely.

Even though numerous characteristics and advantages of the present invention have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A steering-switching and hands-changing assembly for a pneumatic tool comprising:

a switching set having a selector valve being hollow and having a front end having an outer side;

a rear end;

an external surface;

a valve hole formed through the external surface of the selector valve adjacent to the rear end of the selector valve; and an engaging seat axially formed on and protruding from the outer side of the front end of the selector valve; and a switching stem detachably connected to the selector valve and having an engaging claw selectively engaging with the engaging seat of the selector valve and having an inner side facing the outer side of the front end of the selector valve;

an outer side;

an external surface;

a notch formed through the outer side and the inner side of the engaging claw; and an engaging recess formed in the outer side of the engaging claw, and communicating with the notch to form an annular structure at the outer side of the engaging claw with the notch; and a toggle arm formed on and protruding outwardly from the external surface of the engaging claw and being opposite to the notch of the engaging claw;

a speed-adjusting set connected to the switching set and having a speed button movably and rotatably connected to the switching stem and having a mounting tube extending into the selector valve via the engaging seat and having an external surface;

an inner end mounted in the selector valve via the engaging seat; and an outer end extending out of the selector valve in front of the outer side of the engaging claw via the engaging seat; and a rotating tray connected to the external surface of the mounting tube at the outer end of the mounting tube in front of the outer side of the engaging claw, and having an inner side facing the outer side of the engaging claw;

an outer side; and an engaging flange being annular, axially formed on and protruding from the inner side of the rotating tray around the mounting tube, and mounted in the annular structure of the engaging claw that is formed by the notch and the engaging recess; and a trigger set connected to the switching set and the speed-adjusting set, and having a trigger rod mounted through the selector valve, the switching stem, and the speed button, and having an inner end; and an outer end extending in front of the outer side of the rotating tray via the selector valve and the mounting tube;

a trigger connected to the outer end of the trigger rod in the front of the speed button; and an elastic element mounted around the trigger rod that extends out of the speed button, and abutting the rotating tray and the trigger;

wherein a distance is formed between the rotating tray of the speed button and the trigger, and the rotating tray abuts the engaging claw by an elastic force of the elastic element, and the engaging flange of the rotating tray is mounted between the engaging recess and the notch of the engaging claw to maintain the distance between the rotating tray of the speed button and the trigger.

2. The steering-switching and hands-changing assembly for a pneumatic tool as claimed in claim 1, wherein the engaging seat is a polygonal hollow seat and has an external surface; and multiple engaging concave faces formed around the external surface of the engaging seat at spaced intervals; and the engaging claw has two engaging ribs formed on and protruding from the inner side of the engaging claw beside the notch, and respectively engaging with two of the engaging concave faces of the engaging seat to enable the engaging claw to engage with the engaging seat.

3. The steering-switching and hands-changing assembly for a pneumatic tool as claimed in claim 2, wherein the selector valve has a button-positioning structure deposited on the external surface of the selector valve adjacent to the engaging seat;

the button-positioning structure has a holding protrusion radially formed on and protruding from the external surface of the selector valve adjacent to the engaging seat, and communicating with an interior of the selector valve; and a positioning ball mounted in the holding protrusion and partially extending into the interior of the selector valve; and the mounting tube has at least two ball recesses axially formed in the external surface of the mounting tube at a spaced interval;

wherein the positioning ball of the button-positioning structure engages with the mounting tube at one of the at least two ball recesses to hold the mounting tube securely with the selector valve and enable the mounting tube to move axially relative to the selector valve by the positioning ball moving along one of the at least two ball recesses.

4. The steering-switching and hands-changing assembly for a pneumatic tool as claimed in claim 3, wherein the engaging claw of the switching stem further has two free ends; and two holding jaws respectively formed on the free ends of the engaging claw to enable the holding jaws to engage with one of the engaging concave faces of the engaging seat.

5. The steering-switching and hands-changing assembly for a pneumatic tool as claimed in claim 4, wherein the selector valve has a pin recess formed in the external surface of the selector valve adjacent to the button-positioning structure to enable a positioning pin of the pneumatic tool to hold the selector valve securely on the pneumatic tool.

6. The steering-switching and hands-changing assembly for a pneumatic tool as claimed in claim 5, wherein the rotating tray has an external surface;

multiple numeral marks formed on the outer side of the rotating tray at spaced intervals, and corresponding to a rotating speed of the pneumatic tool; and multiple protruding tabs annularly formed on and protruding from the external surface of the rotating tray at spaced intervals.

7. The steering-switching and hands-changing assembly for a pneumatic tool as claimed in claim 6, wherein the rotating tray has a mounting recess formed in the outer side of the rotating tray around the outer end of the mounting tube; and the elastic element is mounted in the mounting recess of the rotating tray.

8. The steering-switching and hands-changing assembly for a pneumatic tool as claimed in claim 7, wherein the trigger has a fixing pin to connect the outer end of the trigger rod securely with the trigger.

9. The steering-switching and hands-changing assembly for a pneumatic tool as claimed in claim 2, wherein the engaging claw of the switching stem further has two free ends; and two holding jaws respectively formed on the free ends of the engaging claw to enable the holding jaws to engage with one of the engaging concave faces of the engaging seat.

10. The steering-switching and hands-changing assembly for a pneumatic tool as claimed in claim 1, wherein the rotating tray has a mounting recess formed in the outer side of the rotating tray around the outer end of the mounting tube; and the elastic element is mounted in the mounting recess of the rotating tray.

11. The steering-switching and hands-changing assembly for a pneumatic tool as claimed in claim 2, wherein the rotating tray has a mounting recess formed in the outer side of the rotating tray around the outer end of the mounting tube; and the elastic element is mounted in the mounting recess of the rotating tray.

* * * * *